US007281649B2

(12) United States Patent
Pyper, Jr.

(10) Patent No.: US 7,281,649 B2
(45) Date of Patent: Oct. 16, 2007

(54) BOTTOM SEAL FOR CONTAINER

(75) Inventor: Thomas David Pyper, Jr., Easton, MD (US)

(73) Assignee: Solo Cup Operating Corporation, Highland Park, IL (US)

( * ) Notice: Subject to any disclaimer, the term of this patent is extended or adjusted under 35 U.S.C. 154(b) by 296 days.

(21) Appl. No.: 10/993,223

(22) Filed: Nov. 19, 2004

(65) Prior Publication Data

US 2006/0108409 A1 May 25, 2006

(51) Int. Cl.
*B65D 3/14* (2006.01)

(52) U.S. Cl. ..... 229/400; 229/4.5; 229/5.5; 229/198.2

(58) Field of Classification Search ..... 229/400, 229/4.5, 5.5, 5.6, 122.31, 198.2
See application file for complete search history.

(56) References Cited

U.S. PATENT DOCUMENTS

| | | | | | |
|---|---|---|---|---|---|
| 2,019,412 | A | * | 10/1935 | Heyndrickx | 229/4.5 |
| 2,103,831 | A | | 12/1937 | Sidon | |
| 2,110,616 | A | * | 3/1938 | Wilcox | 229/5.5 |
| 2,276,578 | A | * | 3/1942 | Hahn | 229/5.6 |
| 2,330,840 | A | * | 10/1943 | O'Neil et al. | 229/5.5 |
| 2,802,407 | A | | 8/1957 | Majer | |
| 2,842,301 | A | | 7/1958 | Albert | |
| 2,917,215 | A | | 12/1959 | Psaty et al. | |
| 3,058,642 | A | * | 10/1962 | Hester | 229/4.5 |
| 3,346,170 | A | * | 10/1967 | Carter | 229/5.5 |
| 4,051,951 | A | * | 10/1977 | Smith | 229/5.5 |
| 4,351,472 | A | * | 9/1982 | Eddy | 229/5.6 |
| 5,476,213 | A | * | 12/1995 | Suski | 229/5.5 |
| 5,967,405 | A | * | 10/1999 | Hanauska | 229/400 |
| D417,845 | S | | 12/1999 | Sadlier et al. | |
| 6,032,823 | A | * | 3/2000 | Bacon | 229/4.5 |
| 6,039,682 | A | | 3/2000 | Dees et al. | |
| 6,085,970 | A | | 7/2000 | Sadlier | |
| 6,135,936 | A | | 10/2000 | Brown et al. | |
| 6,173,858 | B1 | | 1/2001 | Norwood et al. | |
| 6,196,454 | B1 | | 3/2001 | Sadlier | |
| 6,257,485 | B1 | | 7/2001 | Sadlier et al. | |
| 6,264,100 | B1 | | 7/2001 | Brown et al. | |
| 6,287,247 | B1 | | 9/2001 | Dees et al. | |
| 6,378,766 | B2 | | 4/2002 | Sadlier | |
| 6,422,456 | B1 | | 7/2002 | Sadlier | |

FOREIGN PATENT DOCUMENTS

| | | |
|---|---|---|
| EP | 0 995 587 A1 | 4/2000 |
| JP | 58216539 | 12/1983 |

OTHER PUBLICATIONS

Exhibit A: Insulair Triple Wall Cup known at least as early as Sep. 1, 2004; 2 pages.

* cited by examiner

*Primary Examiner*—Gary E Elkins

(57) ABSTRACT

The present invention generally provides a bottom seal for a container. The container has a side wall having an upper end and a lower end. A bottom wall closes the lower end of the side wall. The bottom wall has a base and a skirt projecting from an outer periphery of the base. A bottom seal made of a portion of the lower end of the side wall being folded generally radially inward and back on itself forms a first seal region and an adjacent second seal region. The first seal region includes the skirt and the lower end of the side wall. The second seal region does not include the skirt. One or more concentric ring seals, knurling patterns, or both are formed in at least one of the first and second seal regions of the bottom seal.

10 Claims, 3 Drawing Sheets

BOTTOM SEAL FOR CONTAINER

CROSS-REFERENCE TO RELATED APPLICATIONS

Not Applicable

FEDERALLY SPONSORED RESEARCH OR DEVELOPMENT

Not Applicable

TECHNICAL FIELD

The present invention relates generally to a disposable container, and more specifically to a bottom seal for a container.

BACKGROUND OF THE INVENTION

Various types of bottom seals for containers are well known in the art. While such seals according to the prior art provide a number of advantageous features, they nevertheless have certain limitations. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention generally provides a container comprising a side wall having an upper end and a lower end. A rim is located at the upper end of the side wall. A bottom wall closes the lower end of the side wall to form a cavity therebetween. The bottom wall has a generally disk-shaped base and a skirt projecting from an outer periphery of the generally disc-shaped base. An outer portion of the lower end of the side wall transitions at a crease into an inner portion of the lower end of the side wall. The outer and inner portions abut opposite surfaces of the skirt and a lowermost edge of the skirt is positioned a distance from the crease. A primary seal is formed between the outer and inner portions of the lower end of the sidewall, and a secondary seal is formed between the skirt and the outer and inner portions of the side wall. The secondary seal connects the bottom wall to the side wall. A first circumferential ring is formed in an innermost region of the secondary seal. In one embodiment, the first circumferential ring is formed in a plane substantially parallel to the generally disk-shaped base.

According to another embodiment, the container comprises a second circumferential ring formed in the innermost region of the secondary seal. In one embodiment, the second circumferential ring is formed in a plane substantially parallel to the generally disk-shaped base.

According to another embodiment, the container comprises a second circumferential ring formed in an innermost region of the primary seal. In one embodiment, the second circumferential ring is formed in a plane substantially parallel to the generally disk-shaped base.

According to another embodiment, the first circumferential ring forms an indentation in the secondary seal.

According to another embodiment, the secondary seal is knurled.

According to another embodiment, the lowermost edge of the skirt is located a distance above the crease, and in one embodiment the lowermost edge of the skirt is located less than 1 millimeter above the crease.

According to another embodiment, the lowermost edge of the skirt is located at least 1 millimeter above the crease.

According to another embodiment, the lowermost edge of the skirt is located at least 2 millimeters above the crease.

According to another embodiment, the lowermost edge of the skirt is located at least 3 millimeters above the crease.

According to another embodiment, the side wall is generally conical.

According to another embodiment, the container is made of a paper-based material.

According to another embodiment, the outer and inner portions of the lower end of the side wall are coated with a polymer. The polymer coating forms a substantially liquid-tight bond in the primary seal after heat and pressure are applied.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
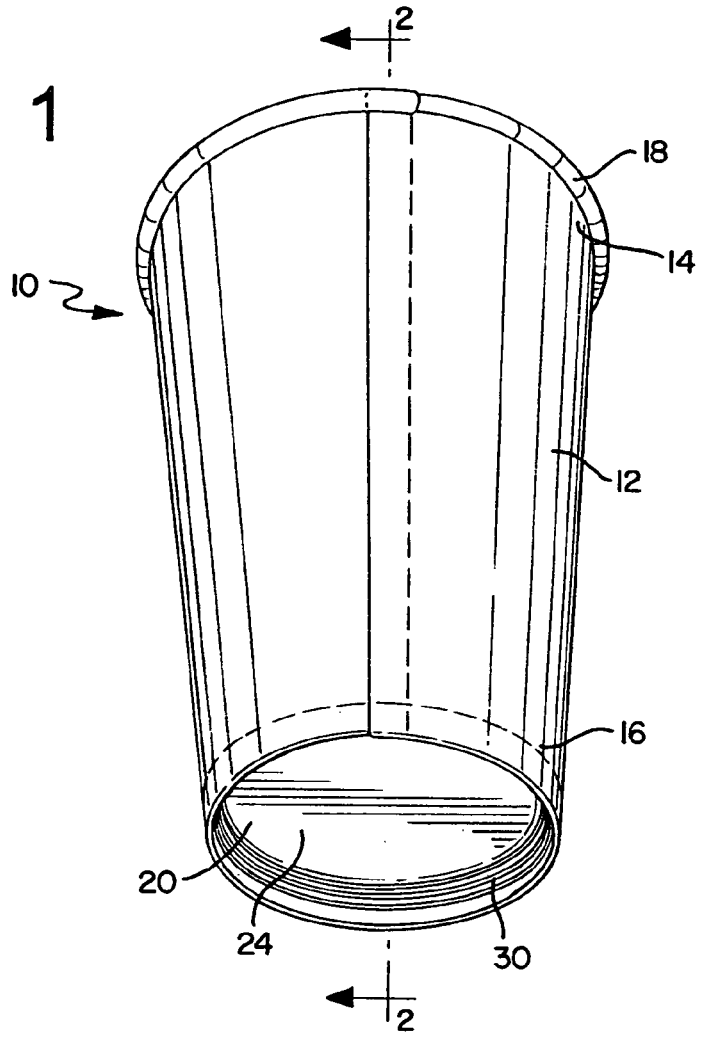
FIG. 1 is a perspective view of one embodiment of a paperboard container having a bottom seal.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. Particularly, the container is described and shown herein as a paperboard cup for containing liquid, such as coffee, tea, water, soda, etc. However, it should be understood that the present invention may take the form of many different types of vessels or containers used for holding hot or cold liquids, including but not limited to beverages, smoothies, soups, stews, chili, etc. A person skilled in the art would readily recognize that the container of the present invention may also be used for holding more solid foods, including but not limited to ice cream, frosting, yogurt, fruit, etc. Additionally, a person skilled in the art would readily recognize that the container of the present invention may be formed of any material or combination of materials, including but not limited to any paper-based material or other natural fiber, metal, polymer such as polypropylene, film, or foam.

Figure 2:
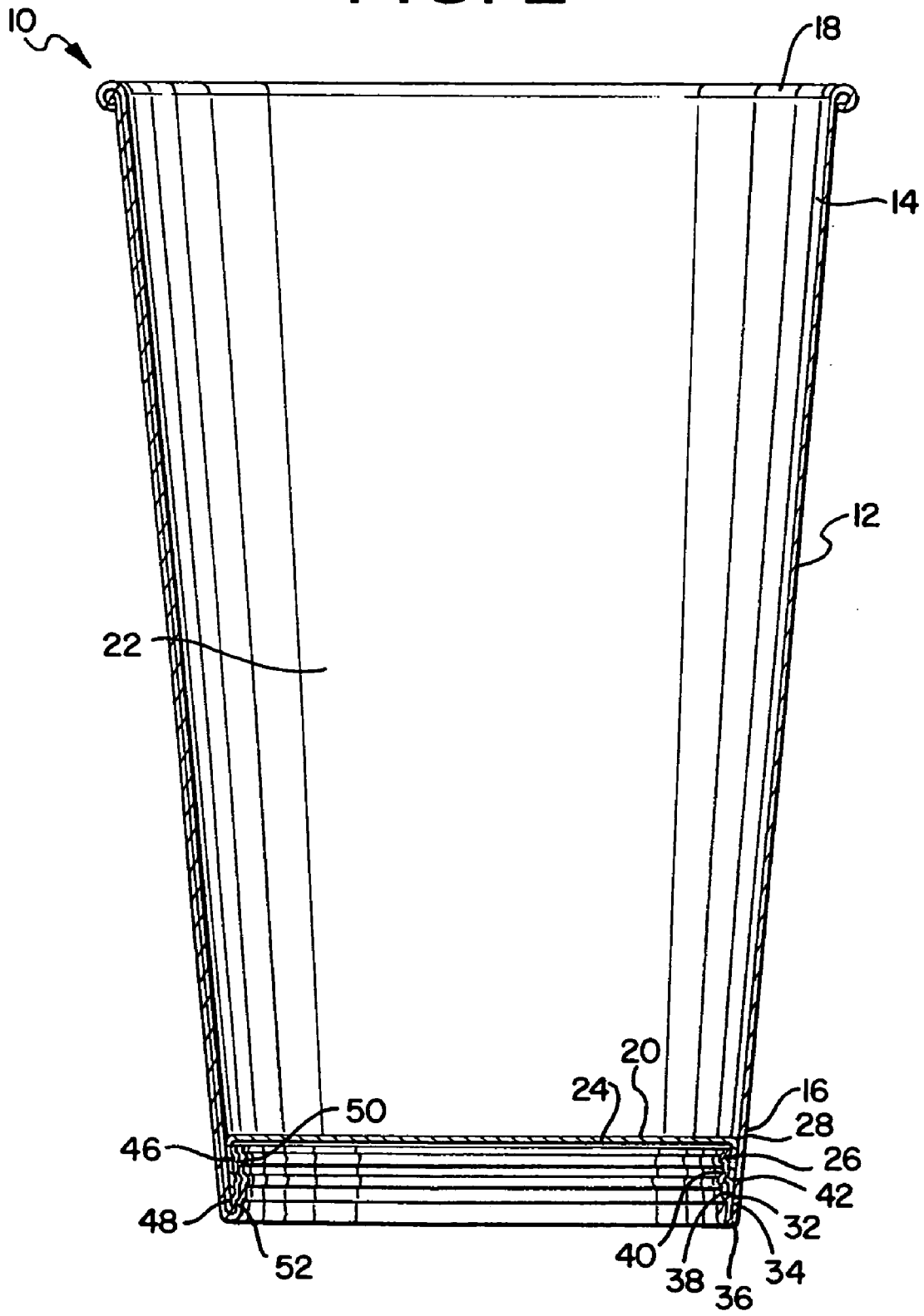
FIG. 2 is a cross-sectional view of the paperboard container of FIG. 1.

Referring now in detail to the FIGS., and initially to FIGS. 1 and 2, there is shown one embodiment of a paperboard container 10. The paperboard container 10 is comprised of a side wall 12 having an upper end 14 and a lower end 16. The side wall 12 can be of the straight wall variety as is commonly used for such things as ice cream and frosting containers, or the side wall can be generally conical in nature as is commonly used for such things as drinking cups. An optional rim 18 can be located at the upper end 14 of the side wall 12, but is certainly not necessary for the practice of the present invention. For example, in the case of a two-piece container having an insert and a separate outsert (not shown), which insert and outsert cooperate to give the look and feel of a single container, the rim may be configured differently or entirely lacking from the insert or the outsert, either of which or both may be configured according to the principles of the present invention.

A bottom wall 20 closes the lower end 16 of the side wall 12 to form a cavity 22 therebetween. The bottom wall 20 has a generally disk-shaped base 24 and a skirt 26 projecting from an outer periphery 28 of the generally disc-shaped base 24. The container 10 further has a bottom seal 30. In general, the bottom seal 30 is made of a portion of the lower end 16 of the side wall 12 being folded generally radially inward and back on itself to form a folded portion 32 of the lower end 16 of the side wall 12. More specifically, the folded portion 32 comprises an outer portion 34 of the lower end 16 of the side wall 12 that transitions at a crease 36 into an inner portion 38 of the lower end 16 of the side wall 12. The outer and inner portions 34, 38 of the lower end 16 of the side wall 12 abut opposite surfaces 40, 42 of the skirt 26. The folded portion 32 thereby envelopes the skirt 26 to form the bottom seal 30 between the bottom wall 20 and the side wall 12.

In one embodiment, the bottom seal 30 comprises a first seal region 46 and an adjacent second seal region 48. The first seal region 46 is proximal the generally disk-shaped base 24 of the bottom wall 20 and the second seal region 48 is distal the generally disk-shaped base 24 of the bottom wall 20. The first seal region 46 includes a secondary seal 50 formed between the skirt 26 and at least one of the outer and inner portions 34, 38 of the lower end 16 of the side wall 12. Accordingly, the secondary seal 50 is generally formed of at least three plies of material. The secondary seal 50 connects the bottom wall 20 to the side wall 12.

Figure 3:
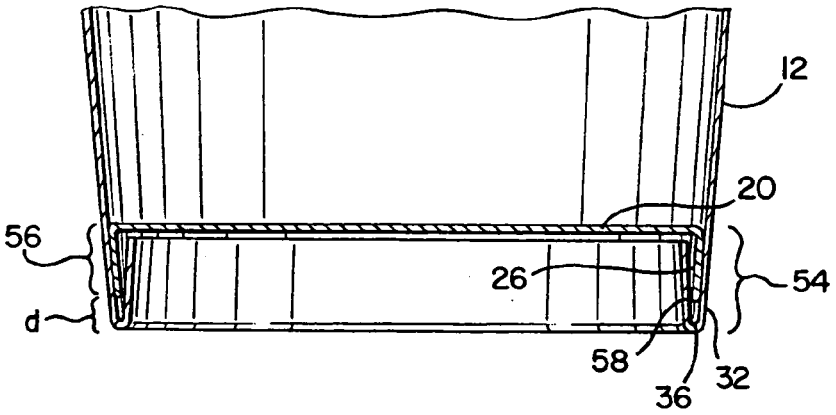
FIG. 3 is a partial cross-sectional view of a partially formed embodiment of a paperboard container.

The second seal region 48 adjacent the first seal region 46 includes a primary seal 52 formed between the outer and inner portions 34, 38 of the lower end 16 of the side wall 12. The second seal region 48 excludes the skirt 26, and is thus generally formed of two plies of material. In one embodiment this is possible because the folded portion 32 of the sidewall 12 has a height 54 that is longer than a length 56 of the skirt 26, as is shown in FIG. 3. FIG. 3 shows an embodiment of the paperboard container 10 that has been partially assembled, but has not yet been sealed by a forming tool (not shown). Accordingly, a lowermost edge 58 of the skirt 26 is positioned a distance d above the crease 36 of the folded portion 32. The distance d between the lowermost edge 58 of the skirt 26 and the crease 36 is preferably less than 1 millimeter, but not zero, more preferably at least 1 millimeter, still more preferably at least 2 millimeters, and most preferably 2.54 millimeters or 0.1 inches. Further, it is understood that the distance d between the lowermost edge 58 of the skirt 26 and the crease 36 can also be as much as 3 millimeters or more.

Various means are available to achieve the desired spacing or distance d between the lowermost edge 58 of the skirt 26 and the crease 36. In one embodiment the length 56 of the skirt 26 is decreased. For example, a typical prior-art cup has a circular-shaped bottom wall having a size with diameter D. Conversely, the bottom wall 20 of this exemplar embodiment would typically have a smaller diameter D'. In one embodiment the bottom wall 20 would have a diameter D' according to the following equation: $D'=D-2d$. Using this equation for the preferred embodiment where $d=0.1$ inches, a person of ordinary skill in the art understands that the diameter of the bottom wall 20 would be manufactured 0.2 inches smaller than in the prior art example provided herein. Thus, in this example, 0.1 inches of the material that makes up each leg or length 56 of the skirt 26 is eliminated. This is beneficial because a large component of bottom leaks of the container 10 appear to be created by the pleat size, i.e., the amount of paper needed to be taken up in each leg or length 56 of the skirt 26 of the bottom wall 20. By reducing the length 56 of the skirt 26, the pleat size is also reduced. In a different example the skirt length may remain the same and the height 54 of the folded portion 32 of the sidewall 12 may be increased.

Figure 4:
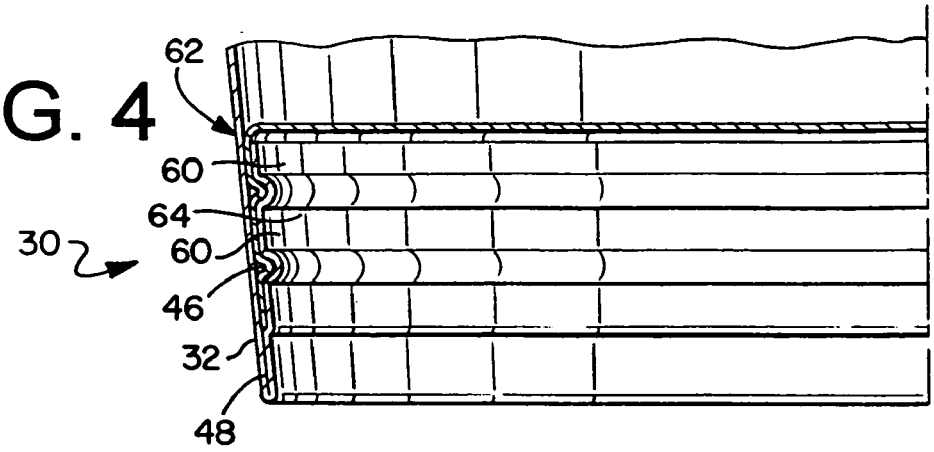
FIG. 4 is a partial cross-sectional view of another embodiment of a paperboard container.
Figure 5:
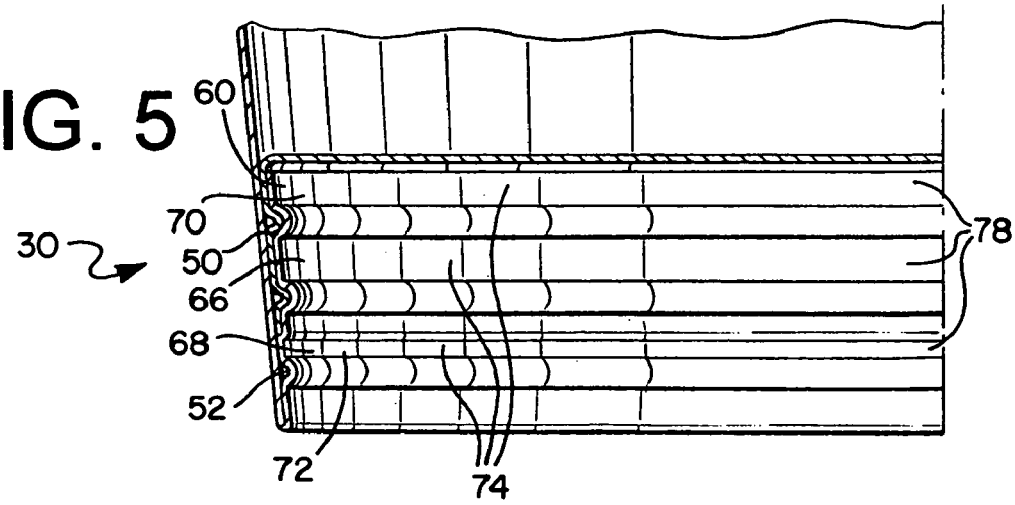
FIG. 5 is a partial cross-sectional view of another embodiment of a paperboard container; and, FIG. 6 is a partial cross-sectional view of another embodiment of a paperboard container.

Additionally, in one embodiment at least one circumferential ring 60, but more preferably a plurality of concentric circumferential rings 60, are formed in the bottom seal 30, as is shown in FIGS. 4 and 5. The plurality of concentric circumferential rings 60 can be formed on an outermost surface 62 or an innermost surface 64 of the folded portion 32 of the bottom seal 30, but are preferably formed on the innermost surface 64 of the folded portion 32. Further, the plurality of concentric circumferential rings 60 can be formed in either or both of the first and second seal regions 46, 48 of the bottom seal 30, but are preferably formed in the first seal region 46. In one example a first circumferential ring 66 is formed in the innermost surface 64 of the folded portion 32 that is part of the secondary seal 50, also referred to as an innermost region 70 of the secondary seal 50, and a second circumferential ring 68 is preferably formed in the innermost surface 64 of the folded portion 32 that is part of the primary seal 52, also referred to as an innermost region 72 of the primary seal 52. Preferably, however, the second circumferential ring 68 could instead be formed in the innermost region 70 of the secondary seal 50, thus providing two circumferential ring seals 68 in the secondary seal 50, and no circumferential ring seals 68 in the primary seal 52. Alternatively, both the first and second circumferential rings 66, 68 can be formed in the innermost region 72 of the primary seal 52. In a preferred embodiment, both the first and second circumferential rings 66, 68 are formed in planes substantially parallel to the generally disk-shaped base 24 and to one another.

Figure 6:
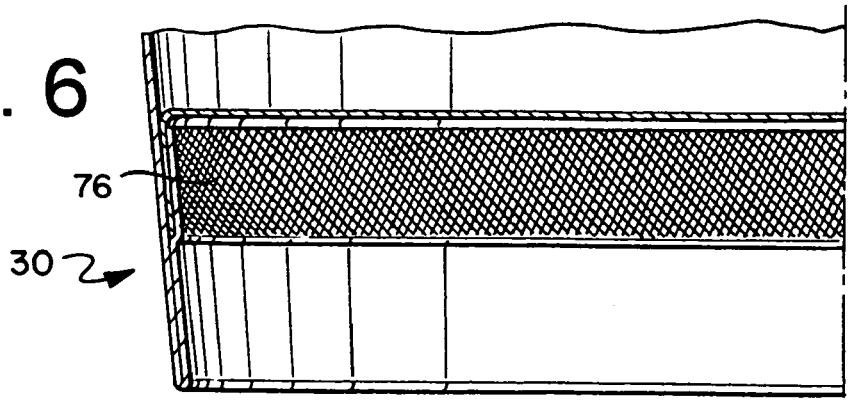

Each circumferential ring 60 generally forms an indentation 74, groove or some other type of three-dimensional seal area (not shown) in either the secondary seal 50 or the primary seal 52 of the folded portion 32 using tooling techniques known in the art. Additionally, it is understood that the secondary seal 50 may be formed of a knurled portion 76, as shown in FIG. 6. Knurling, a sealing technique well known in the art, produces a series of small ridges or otherwise patterned grooves in the seal area. Whether indented, knurled, or otherwise three-dimensionally formed, each secondary seal 50 forms a seal in the folded portion 32 to further prevent leaking of the container 10.

Additionally, the primary seal 52 is comprised of a seal that can be formed through a variety of sealing means. Accordingly, the primary seal 52 can be formed as a substantially smooth or straight-wall component, a knurled component, a component having circumferential rings, or a component having other three-dimensional areas thereto as described above.

The paperboard of the container 10 can be coated with a polymer or another type of workable coating, or an adhesive, for creating the seal component of the bottom seal 30. The coating or adhesive forms a substantially liquid-tight bond in the primary seal 52 of the second seal region 48 after heat and/or pressure are applied. This liquid-tight bond is formed just below the lowermost edge 58 of the skirt 26. Further, the skirt 26 enveloped within the folded portion 32 is preferably bonded thereto with a similar polymer or adhesive bonding. Thus, it is understood that at least a portion of the secondary seal 50 generally comprises a three-layer component, and at least a portion of the primary seal 52 generally comprises a two-layer component. It is also understood that the container 10 can be uncoated, single-polymer coated (only one surface of the side wall 12 is coated), double-polymer coated (both surfaces of the side wall 12 are coated), or any combination of these options.

Accordingly, the container 10 of the present invention provides a simple and inexpensive way to improve the sealing properties of paperboard and other types of containers 10. Specifically, reducing the length 56 of the skirt 26 minimizes the amount of material to be taken up in the bottom seal 30 of the container 10 and allows the surfaces of the folded lower end 16 of the side wall 12 to be bonded or adhered together in the primary seal region 52 to form a substantially liquid-tight seal. This liquid-tight seal is formed just below the lowermost edge 58 of the skirt 26. Therefore, even if liquid penetrated the first seal region 46 (i.e., the secondary seal 50), the liquid should not penetrate the second seal region 48 (i.e., the primary seal 52). Additionally, each circumferential ring 60 formed in the folded portion 32 forms a ring seal 78 that assists in further preventing leaking of the container 10 by forming a separate barrier to the migration of the liquid in the container 10. As such, the present invention overcomes the deficiencies seen in the prior art.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "primary," "secondary," etc. as used herein are intended for illustrative purposes only and do not limit the embodiments in any way. Further, the term "plurality" as used herein indicates any number greater than one, either disjunctively or conjunctively, as necessary, up to an infinite number.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying claims.

What is claimed is:

1. A container comprising:

a side wall having an upper end and a lower end;

a rim at the upper end of the side wall;

a bottom wall that closes the lower end of the side wall to form a cavity therebetween, the bottom wall having a base and a skirt projecting from an outer periphery of the base;

an outer portion of the lower end of the side wall that transitions at a crease into an inner portion of the lower end of the side wall, the outer and inner portions abutting opposite surfaces of the skirt, wherein a lowermost edge of the skirt is positioned a distance from the crease;

a primary seal formed between the outer and inner portions of the lower end of the side wall;

a secondary seal formed between the skirt and the outer and inner portions of the side wall, wherein the secondary seal connects the bottom wall to the side wall, and wherein the secondary seal is formed of a three-dimensional component, wherein the three-dimensional component in the secondary seal comprises a first circumferential ring provided in a plane substantially parallel to the base; and a second circumferential ring in an innermost region of the primary seal, the second circumferential ring being in a plane substantially parallel to the base.

2. The container of claim 1, wherein the base is generally disk-shaped.

3. The container of claim 1 further comprising:

a third circumferential ring in the innermost region of the secondary seal, the second circumferential ring being in a plane substantially parallel to the base.

4. The container of claim 1, wherein the first circumferential ring forms an indentation in the secondary seal.

5. The container of claim 1, wherein the three-dimensional component comprises a knurled seal.

6. The container of claim 1, wherein the lowermost edge of the skirt is located at least 1 millimeter above the crease.

7. The container of claim 1, wherein the lowermost edge of the skirt is located at least 2 millimeters above the crease.

8. The container of claim 1, wherein the lowermost edge of the skirt is located at least 3 millimeters above the crease.

9. The container of claim 1, wherein the side wall is generally conical.

10. The container of claim 1, wherein the container is made of a paper-based material.

* * * * *